US005226529A

United States Patent [19]

Valenzona

[11] Patent Number: 5,226,529

[45] Date of Patent: Jul. 13, 1993

[54] STABLE ON SWITCH

[75] Inventor: Joseph F. Valenzona, El Toro, Calif.

[73] Assignee: Judco Manufacturing, Inc., Harbor City, Calif.

[21] Appl. No.: 688,162

[22] Filed: Apr. 19, 1991 (Under 37 CFR 1.47)

[51] Int. Cl.[5] ..... H01H 3/02; H01H 19/62

[52] U.S. Cl. ..... 200/529; 200/527; 200/528

[58] Field of Search ..... 200/523, 526, 527, 528, 200/529, 530, 341, 345, 568

[56] References Cited

U.S. PATENT DOCUMENTS

| | | | |
|---|---|---|---|
| 3,694,603 | 9/1972 | Congelliere et al. | 200/526 |
| 4,225,764 | 9/1980 | Buttner | 200/526 X |
| 4,317,015 | 2/1982 | Buttner et al. | 200/526 |
| 4,345,128 | 8/1982 | Buttner et al. | 200/526 |
| 4,939,328 | 7/1990 | Smith | 200/527 |
| 4,950,856 | 8/1990 | Valenzona | 200/526 |
| 4,985,605 | 1/1991 | Valenzona | 200/526 X |
| 4,996,401 | 2/1991 | Park | 200/527 |
| 4,997,999 | 3/1991 | Valenzona | 200/527 X |
| 5,001,316 | 3/1991 | Salaman | 200/526 X |
| 5,049,709 | 9/1991 | Prickett et al. | 200/527 |
| 5,132,499 | 7/1992 | Valenzona et al. | 200/526 |

*Primary Examiner*—Henry J. Recla
*Assistant Examiner*—Glenn T. Barrett
*Attorney, Agent, or Firm*—Noel B. Hammond; Kenneth W. Float

[57] ABSTRACT

A pushbutton switch which permits partial actuation without a change of state, including a body, a cover and a contact cup having a plurality of tabs, the cup rotatably mounted on the cover. A plunger and ratchet mechanism mounted in the body incrementally rotate the contact cup and tabs upon successive actuations of the switch. A first terminal mounted on the cover is interruptibly in contact with one of the tabs as they are rotated by operation of the ratchet mechanism, while a second terminal mounted on the cover maintains electrical contact with the contact cup. A plurality of camming ramps formed in the cover are in intermittent communication with the tabs, first lifting them above a planar portion of the first terminal, then permitting one of them to come to rest on the planar portion of the terminal completing an electrical circuit between the first and second terminals. In another embodiment, a third terminal is mounted on the cover in a coplanar spaced apart relationship with the first terminal. Successive actuations of the switch causes the tabs to alternatively come to rest on the first and third terminals completing an electrical circuit through the switch between the second terminal and one of the first or third terminals.

18 Claims, 6 Drawing Sheets

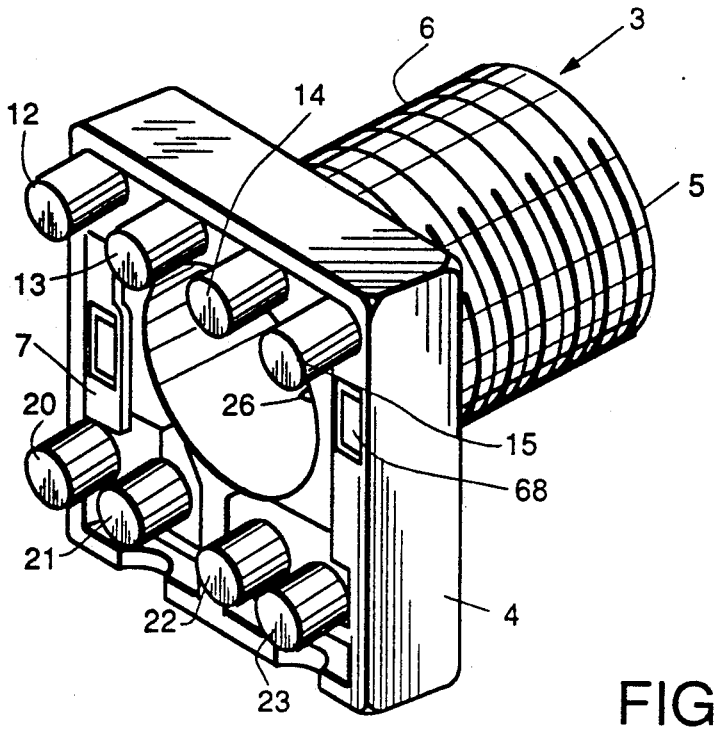
FIG. 3.
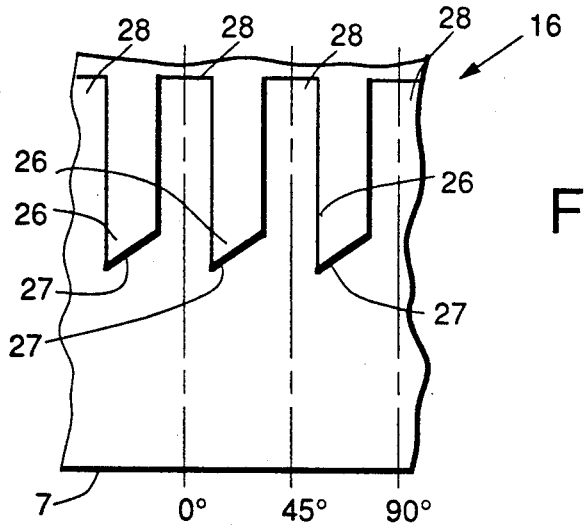
FIG. 4.
FIG. 5.
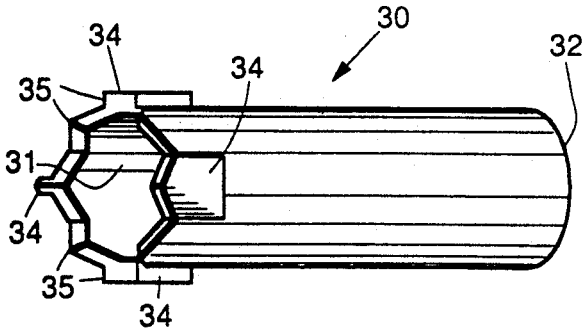

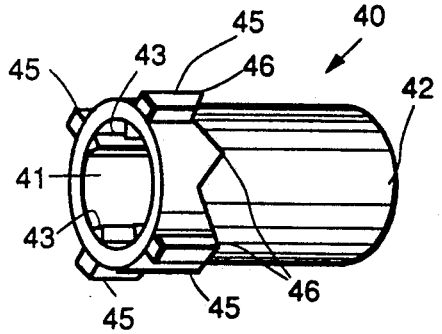
FIG. 6.
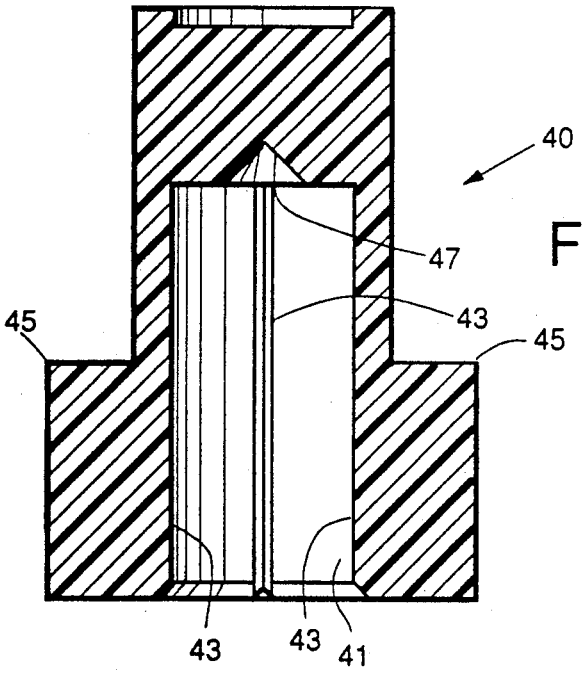
FIG. 7.
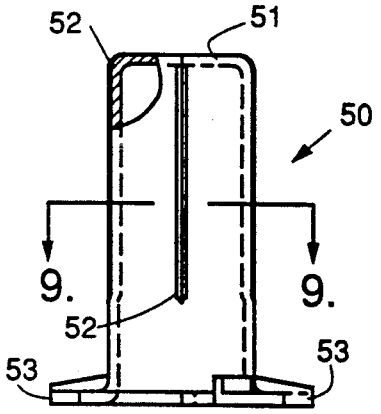
FIG. 8.
FIG. 9.
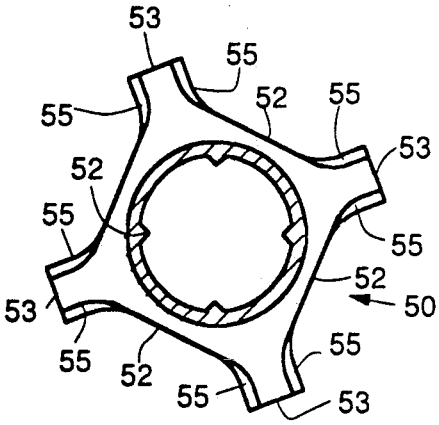

STABLE ON SWITCH

BACKGROUND

The present invention relates to pushbutton switches for use in electrical circuits and in particular to pushbutton switches which exhibit a stable on operating characteristic. The stable on characteristic prevents an intermittent change of state from occurring during a partial actuation of the switch.

Pushbutton switches are well known in the art and examples thereof may be found in U.S. Pat. Nos. 3,694,603, 4,055,736 and 4,345,128 the disclosures of which are incorporated herein by reference. The foregoing patents disclose pushbutton switches adapted to sequentially open and close an electrical circuit or to sequentially switch a common lead between two alternate portions of a circuit. In addition to the switches shown in the above patents, other designs are known in the art, having a variety of configurations, adapted for similar function.

A problem often found with pushbutton switches is an instability caused by a partial actuation of the switch's plunger. When in the closed state, a very small depression of the plunger causes the switch to momentarily open. Upon release of the plunger, the switch returns to its original state.

Pushbutton switches are often used in conjunction with cosmetic housings having a switch actuating lever or button. Such housings may be found on industrial machinery, consumer appliances and automotive vehicles. Various manufacturing and assembly problems are encountered in the mounting of a pushbutton switch in such a housing. For example, tolerance stacking may cause the housing lever to hold the switch plunger in a partially actuated position. External vibration may then cause the switch to intermittently open when it is in the closed state.

In an attempt to resolve this problem, the prior art has suggested the use of various actuating mechanisms to achieve a switch exhibiting a stable on characteristic. However, up to the present, the alternatives proposed have incorporated features introducing problems and disadvantages in their operation.

For example, the switch disclosed in U.S. Pat. No. 4,906,808 to Burgess et al., directly addressed the instability problem. In the older art referenced above, switch operation includes a contact member which is raised and lowered and which may additionally be rotated. The contact is rigidly fixed to a plunger and ratcheting mechanism. The contact's movement away from the terminals of the switch begins with the initial movement of the plunger.

In the '808 patent, the plunger and ratcheting mechanism are not rigidly fixed to the contact member. Contact movement is solely rotational and begins near the end of the plunger downstroke. This allows for a partial movement of the plunger with no effect on the state of the switch. However, to achieve this desired stable on feature, the '808 switch incorporated several disadvantages well known in the art. The switch utilizes contact bridging, actuation on the downstroke and terminal edge-contact impacting. These features result in a relatively high magnitude of contact wear, a relatively high plunger actuating force and increased manufacturing costs.

The contact bridging arrangement requires that the contact simultaneously engage two terminals to close the switch. The contact is biased into communication with the terminals by a spring. A minimum force is necessary between the contact and each terminal to insure good electrical communication. As there are two terminals, the required force of the spring is greater than that which would be required if the contact itself acted as a terminal and communication was required with only one other terminal, a non-bridging arrangement. The required greater spring force results in increased wear between the contact and the terminals and increases the force needed to actuate the switch.

As the switch operates on the downstroke, when the spring is in a nearly fully compressed state, the force of the spring is at its highest during switch actuation. This high spring force acts against the contact member at the time it is sliding over the terminals causing a relatively high rate of friction and wear between the contact and the terminals.

Finally, in operation, the contact member initially impacts the side and top connecting edge of each terminal. Then due to ramping forces developed by the shape of the contact, the contact moves up over this edge and finally comes to rest on the top of the terminals. This impact greatly increases the wear of the terminals and the contact. In order to minimize this wear, it is necessary to keep the height of the terminal edge, relative to the plane on which the contact member rotates, within very close tolerances. Maintaining these tolerances requires precision molding, increasing the cost of manufacture of the switch.

There is, therefore, a need for an improved pushbutton switch which provides a stable on feature with a normal actuating force, a low wear characteristic, and which is economical to manufacture.

SUMMARY OF THE INVENTION

The present invention provides an improved pushbutton switch having the desired characteristics stated above. In its presently preferred embodiment, the switch comprises a body having a barrel portion and a cover. The cover includes a guide post extending away from the cover into the barrel. A contact cup having an open end and a partially closed end is rotatably mounted on the guide post. The cup has a plurality of tabs radially extending from its open end. A plunger and ratchet mechanism for rotating the cup are mounted within the barrel, the plunger extending away from the body out of the end of the barrel. Two terminals are mounted on the cover, the first having a planar portion for interruptibly communicating with one of the tabs, the second being in continuous communication with the cup. A spring mounted between the ratchet mechanism and the tabs biases the tabs into interruptible communication with the first terminal. The cover includes a plurality of camming ramps intermittently in communication with the tabs. On sequential pushes of the plunger, at least one of the tabs rides up a ramp, lifting the tab then adjacent to the first terminal above the terminal's planar surface. As this tab continues to rotate, it passes off the ramp onto the surface of the terminal completing an electrical circuit through the switch between the first and second terminals. The next push of the plunger rotates the tab off of the first terminal disconnecting the circuit.

In another preferred embodiment of the invention, a third terminal having a planar portion is mounted on the cover. The third terminal is placed in a spaced apart relationship with the first terminal, its planar portion being coplanar with the planar portion of the first terminal. When the plunger is depressed, at least one tab rides up a ramp, raising all the tabs above the plane of the planar portion of the terminals. When the plunger is released, one tab comes to rest on the first terminal completing a circuit through the switch between the first and second terminals. The next depression and release of the plunger rotates the tab off the first terminal opening the circuit. Simultaneously, another tab rides up a ramp and comes to rest on the third terminal completing a circuit through the switch between the second and third terminals. Successive operations of the plunger causes the tabs to continue to alternatively complete a circuit between the second terminal and either the first or the third terminals,

BRIEF DESCRIPTION OF THE DRAWINGS

The features and advantages of this invention are more fully set forth in the following description of the presently preferred embodiments. The description is presented with reference to the accompanying drawings in which:

FIG. 3 is a perspective view of a body portion of the switch shown in FIGS. 1 and 2;

FIG. 4 is a broken away portion of an interior wall of a barrel forming part of the body depicted in FIG. 3, the wall shown flattened out to illustrate splines located therein;

FIG. 5 is a perspective view of a plunger adapted for movement within the body portion of the switch shown in FIGS. 1, 2 and 3;

FIG. 6 is a perspective view of a ratchet adapted for insertion within the plunger shown in FIGS. 2 and 5;

FIG. 7 is a side view in cross-section of the ratchet of FIG. 6;

FIG. 8 is a side view partly broken away of a contact cup, taken along its long axis, the cup adapted for insertion within the ratchet shown in FIGS. 2, 6 and 7;

FIG. 9 is a cross-sectional view of the contact cup shown in FIG. 8 taken along line 9—9;

DETAILED DESCRIPTION

Figures 1, 2:
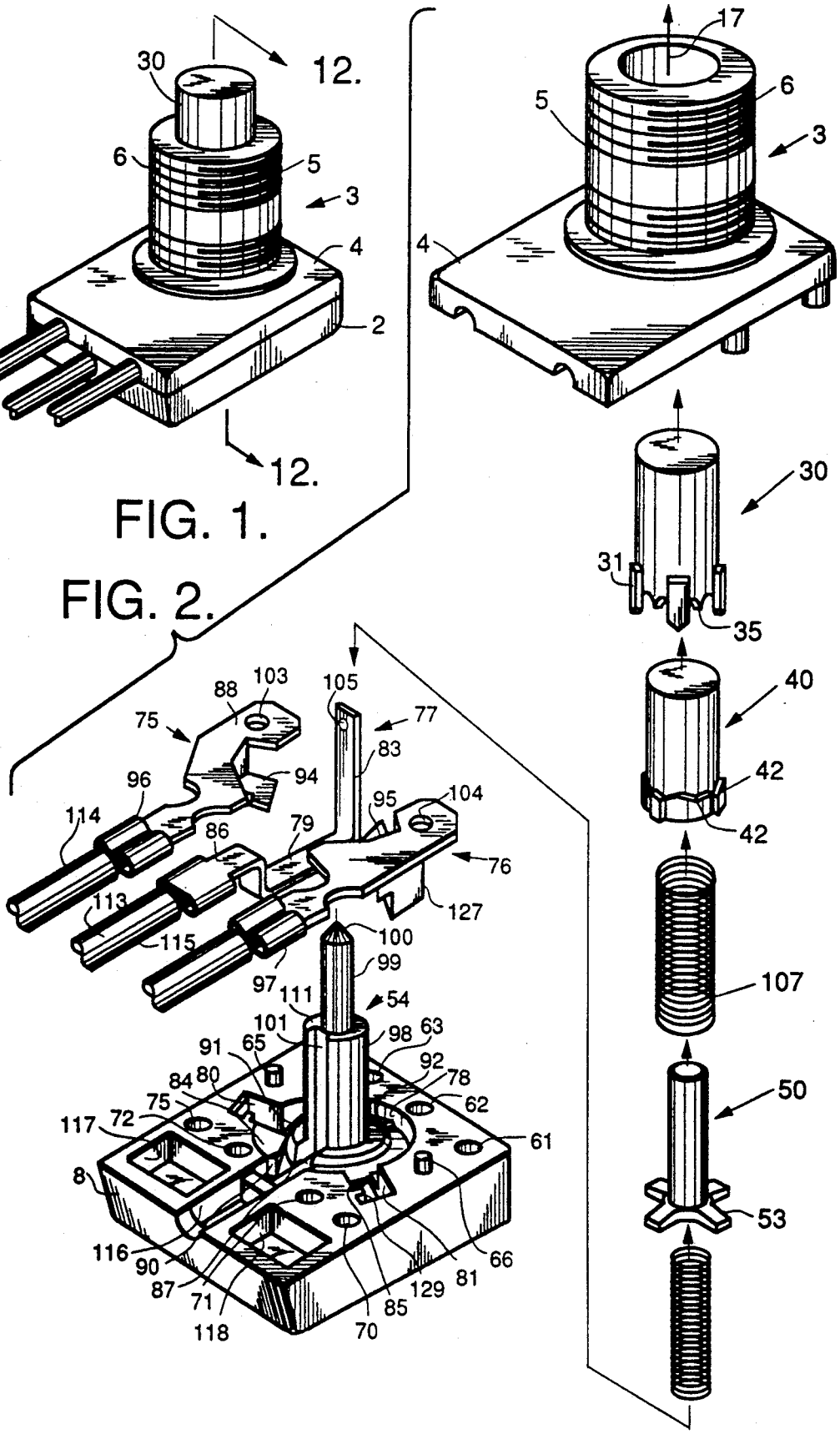
FIG. 1 is a perspective view of a presently preferred embodiment of the present invention.
FIG. 2 is an exploded, perspective view of the switch of FIG. 1.

Referring to FIGS. 1 and 2, there are shown perspective and exploded views of a preferred embodiment of the present switch invention. The switch includes separable housing portions comprising a cover 2 and a body 3. A plunger 30, ratchet 40 and contact cup 50 are contained within the body 3.

Referring to FIG. 3, the body has a planar portion 4 and a barrel 5. The barrel 5 is open at its ends and may or may not have threads 6 on its exterior surface. The planar portion 4 of the body 3 is provided with a mating surface 7. The mating surface 7 has a plurality of spaced pin members, with eight pin members 12–15 and 20–23 being preferably used. The pin members are disposed in two substantially parallel rows on opposite sides of the barrel 5 and are engagable with recesses correspondingly located in a conforming surface 8 of the cover 2, as described below.

A broken away and flattened portion of the interior wall 16 of the barrel 5 is shown in FIG. 4. Splines 26 having spaced apart parallel walls extend along the axis 17 of the barrel 5. Ramps 27 form the end of the splines 26 closest to the mating surface 7. The ramps 27 are offset from the axis 17 and form an acute angle of about 38° from the longest axial side of the splines 26. The splines 26 are formed by molding the barrel 5 to have a thicker wall in the region of the splines 26 than in the remainder of the barrel 5. The thinner wall portions between adjacent splines comprise ways 28.

The plunger 30 is shown in FIG. 5. The plunger 30 is adapted for axial sliding movement within the barrel 5. The plunger 30 is tubular in form having an open end portion 31 and a closed end portion 32. When inserted in the body 3, the closed end portion 32 projects out of the barrel 5 providing a primary actuating button for operation of the switch. The open end portion 31 carries a plurality of circumferentially spaced lugs 34, with four lugs 34 being employed in this preferred embodiment. The lugs 34 are spaced 90° apart projecting radially outward. When the plunger 30 is within the barrel 5, the lugs 34 ride in the ways 28 and engage the splines 26. The length of the splines 26 is sufficient to maintain engagement with the lugs 34 during the full actuation of the switch, preventing angular rotation of the plunger 30 relative to the barrel 5.

The open end portion 31 additionally comprises a plurality of evenly spaced camming teeth 35. The camming teeth 35 form a sawtooth annular ring on the end of the plunger 30. This preferred embodiment utilizes eight camming teeth 35, four of which are formed by end portions of the lugs 34.

The ratchet mechanism of the switch comprises the spline ramps 27 and the ways 28 of the barrel 5, the lugs 34 and camming teeth 35 of the plunger 30 and a ratchet 40. Referring to FIGS. 6 and 7, the ratchet 40 is comparable in shape to the plunger 30, having an open end portion 41 and a closed end portion 42. The closed end portion 41 and a substantial portion of the barrel of the ratchet 40 are insertable into the plunger 30. The closed end portion 42 is provided with a conical recess 47 in the interior thereof. A plurality of elongated axial V-shaped ribs 43 are formed in the interior wall of the ratchet 40, four ribs 43 being presently preferred, spaced 90° apart. The open end portion 41 carries a plurality of circumferentially spaced dogs 45, with four dogs 45 being preferred in this embodiment. The dogs 45 are spaced 90° apart around the ratchet 40, projecting radially outward therefrom. When the ratchet 40 is inserted into the barrel 5, the dogs 45 first engage the ramps 27 and then finally enter the ways 28. The splines 26 are of a length to permit disengagement with the dogs 45 during actuation of the switch, permitting angular rotation of the ratchet 40 relative to the barrel 5 and the plunger 30.

The open end portion 41 is additionally provided with a plurality of evenly spaced camming teeth 46, distributed around the exterior surface of the ratchet 40. The camming teeth 46 face towards and are adapted to mate with the plunger. camming teeth 35. When the camming teeth 35, 46 of the plunger 30 and the ratchet 40 are confined within the ways 28, the lugs 34 and the dogs 45 are displaced from one another by about 11° for reasons explained below.

Figure 10:
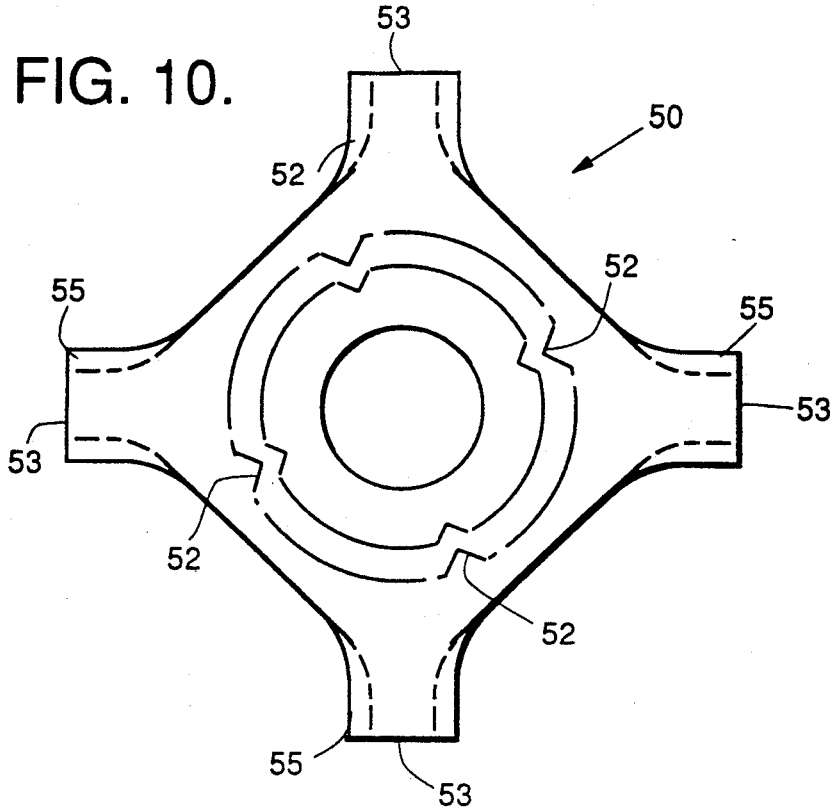
FIG. 10 is a bottom plan view of the contact cup of FIGS. 8 and 9 showing the interior thereof.

FIGS. 8, 9 and 10 illustrate the contact cup 50. The contact cup 50 is made of a conductive material such as 70/30 cartridge brass, or the like, and is adapted for rotation to make and break electrical connections with a left terminal 75 and a right terminal 76 as described below. The contact cup 50 is generally tubular in shape having one end open and the other end partially closed. The partially open end has a circular opening 51 which provides a bearing surface for a central post stud 54. The central post stud 54 extends from the cover 2 into the barrel 5 along the barrel axis 17. The open end of the contact cup 50 has several tabs 53, extending radially outward from the circumference thereof. In the presently preferred embodiment, four radial tabs 53 are evenly spaced around the open end. During switch operation, the tabs 53 engage in alternate wiping contact with a portion of the left and right terminals 75, 76. The tabs 53 are provided with turned up edges 55 to prevent galling the terminals 75, 76 when making such contact with them.

The contact cup 50 is additionally provided with a plurality of elongated axial V-shaped grooves 52 on its external surface. The grooves 52 begin at the partially closed end and extend along the body of the cup 50 nearly the full distance to the open end. The partially closed end of the cup 50 and the portion of its length containing the grooves 52 are adapted to be inserted and keyed with a slide fit into the ratchet 40. The grooves 52 are of the same number and are adapted to mate with the ribs 43 within the ratchet 40. The mating of the ribs 43 and grooves 52 causes the ratchet 40 and contact cup 50 to rotate as a single unit when the switch is actuated. The ribs 43 and grooves 52 are aligned such that the tabs 53 are displaced approximately 22.5° from the ratchet dogs 45.

Figure 11:
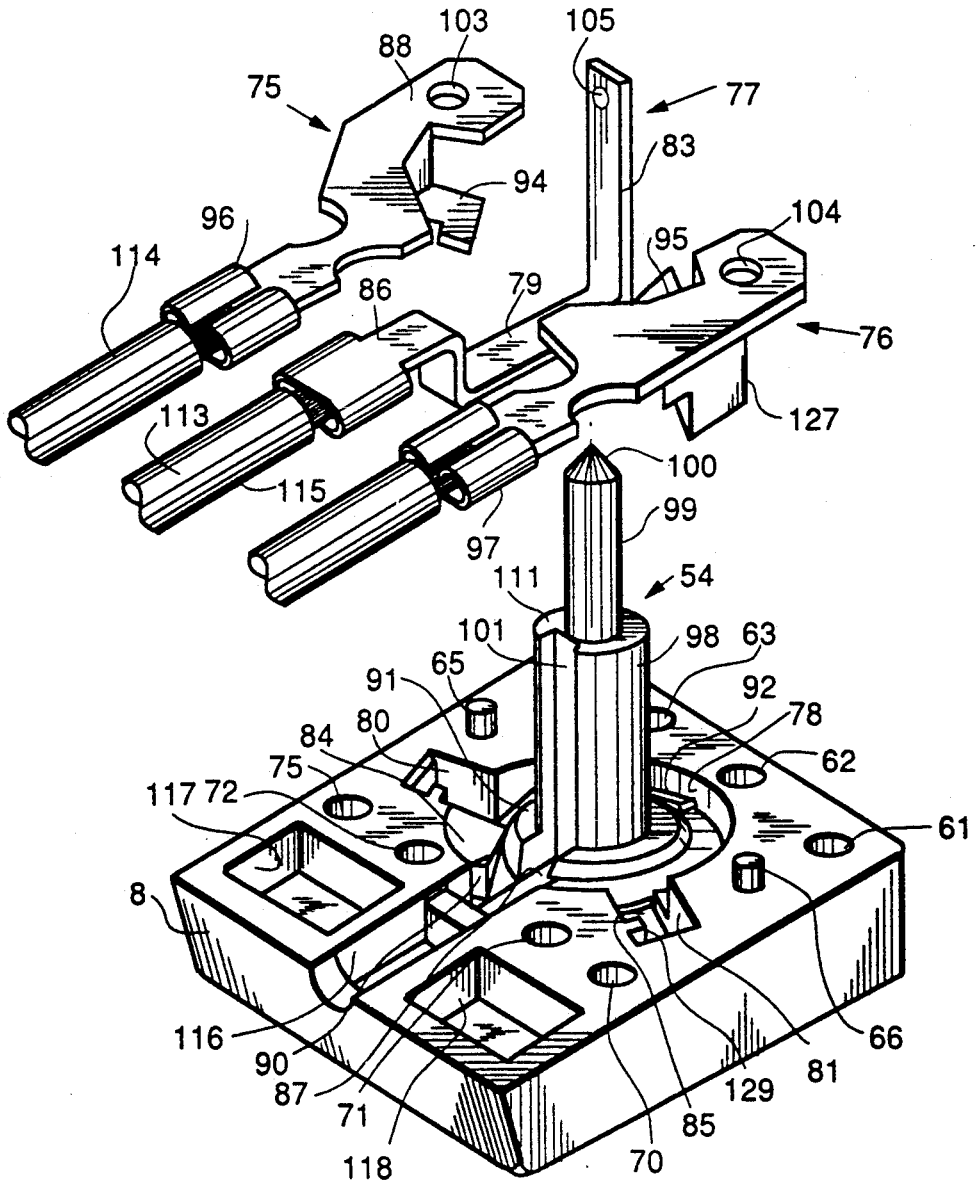
FIG. 11 is an exploded, perspective view of the cover portion of the switch shown in FIGS. 1 and 2.

The cover 2 is shown in FIG. 11. The cover 2 is provided with a plurality of recesses in its conforming surface 8. Eight holes 61–64 and 70–73 are disposed in two substantially parallel rows on opposite sides of the central post stud 54. The holes are adapted to mate with pin members 12–15 and 20–23 located in the mating surface 7 of the switch body 3. The cover 2 and the body 3 are preferably held together by means of an interference fit between the holes and the pin members. An approximately circular recess or cavity 78 extends into the cover 2 with its center aligned with the barrel axis 17. The central post stud 54 extends perpendicularly away from the center of this recess or cavity 78. Two terminal recesses 80, 81 open into the circular recess or cavity 78.

The bottom of the circular recess or cavity 78 is planar and has a center channel 87, two terminal platforms 84, 85, two main camming ramps 90, 93 and two auxiliary camming ramps 91, 92 located thereon. The terminal recesses 80, 81 are located approximately 67.5° on either side of a center channel 82. The ramps 90–93 slope upward from the bottom of the circular recess or cavity 78 at an angle of about 19° in a clockwise direction when viewed from above. One of the main ramps 90, 93 is located before each of the terminal platforms 84, 85, moving in a clockwise direction as viewed from above. The main ramps 90, 93 provide a smooth transition from the bottom of the circular recess or cavity 78 to a height just above that of the terminal platform, as described more fully below. The auxiliary ramps 91, 92 are located at about 126° and 169° from the center channel 82, moving in a clockwise direction, and are contoured the same as the main ramps 90, 93.

Two terminal locating posts 65, 66 extend away from the conforming surface 8 of the cover 2, the posts 65, 66 being preferably located between the parallel rows of holes. Two recesses 67, 68 are located in the mating surface 7 of the body 3 to receive the locating posts 65, 66.

The left and right terminals 75, 76 each include a mounting portion 88, 89, a planar contact portion 94, 95, a crimped end portion 96, 97 and a locating hole 103, 104. The terminals 75, 76 are mounted on the cover 2 and held in place by the mating surface 7 of the body 3, the mating surface 7 being recessed to conform to the shape of the terminals 75, 76. The terminals 75, 76 are secured in position by the locating posts 65, 66 which pass through the locating holes 103, 104. The terminals 75, 76 are additionally secured in position by adjacent vertical members 126, 127 of the contact portions 94, 95 which seat in the terminal recesses 80, 81. The vertical members 126, 127 are held position-captive by ribs 128, 129 which are integrally molded with the cover 2 and are as shown in FIG. 11. When seated, the contact portions 94, 95 are located in a plane above, and are coplanar with, the bottom of the circular recess or cavity 78.

The central post stud 54 comprises a lower center post 98, and an upper guide post 99. The lower center post 98 has a channel relief 101. The upper guide post 99 is provided with a conical tip 100 which passes through the circular opening 51 of the contact cup 50. The conical tip 100 mates with the conical recess 47 provided in the interior of the ratchet 40. The upper guide post 99 acts as a rotational guide for the contact cup 50. The conical tip 100 acts as a stop for the ratchet 40 when the plunger 30 is depressed all the way to the bottom. This prevents deformation damage to the tabs 53 of the contact cup 50. Engagement of the conical tip 100 with the mating conical recess 47 in the interior of the ratchet 40 prevents the upper guide post 99 from deflecting to one side when the plunger 30 is depressed all the way to the bottom.

A common terminal 77 is additionally located on the cover 2. The common terminal 77 has a substantially U-shaped portion 79, a right-angled portion 83 and a crimped end portion 86. The end of the right-angled portion 83 is provided with a dimple 105, which at all times maintains electrical contact with the contact cup 50. The U-shaped portion 79 seats in the center channel 87 while the right-angled portion 83 is positioned in the channel relief 101.

The crimped end portions 86, 96 and 97 of the terminals are attachable to conventional electrical conductors 113, 114 and 115, respectively, to connect the switch to a common lead and two portions of an electrical circuit. Recesses 116, 117 and 118 are located in the conforming surface 8 of the cover 2 to provide clearance for the crimped end portions 86, 96 and 97.

Figure 12:
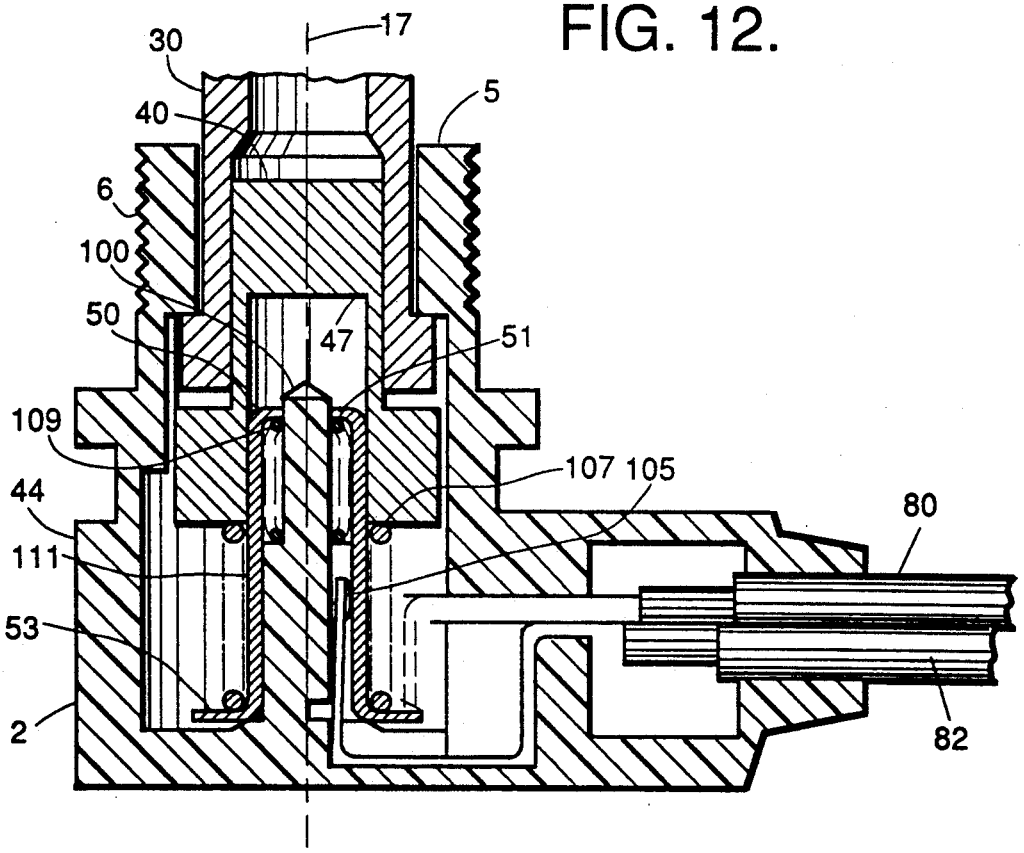
FIG. 12 is a sectional view of the switch shown in FIG. 1 taken along line 12—12.

FIG. 12 shows a sectional view of the switch taken along line 12—12 of FIG. 1. When assembled, the plunger 30 is inserted in the barrel 5, the ratchet 40 is positioned in the plunger 30, the contact cup 50 is inserted in the ratchet 40, and the cup opening 51 is positioned so that the contact tip 100 extends therethrough. A primary helical spring 107 is disposed around the outside of the contact cup 50 and seats between the radial tabs 53 and the open end portion 41 of the ratchet 40. The primary spring 107 provides a continual force against the tabs 53, biasing one of the tabs 53 against one of the left or right terminals 75, 76. An additional auxiliary helical spring 109 is positioned inside the contact cup 50. One end of the auxiliary spring 109 engages the partially closed end of the cup 50 while the other end seats against a shoulder 111 formed by the junction of the upper guide post 99 and the lower center post 98. The auxiliary spring 109 is not required for switch operation, but when used, provides a bearing surface which assists in properly straightening the contact cup 50 while rotating about the upper guide post 99. The use of the auxiliary spring 109 results in a smoother switch action. The force provided by the auxiliary spring 109, which operates opposite to the primary spring 107, is approximately two to three orders of magnitude smaller than that of the primary spring 107. Spring force of about 1.2 lbs for the primary spring 107, and about 0.15 lbs for the auxiliary spring 109 at working lengths at the point of ratchet are typical for this preferred embodiment of the switch.

Figure 13:
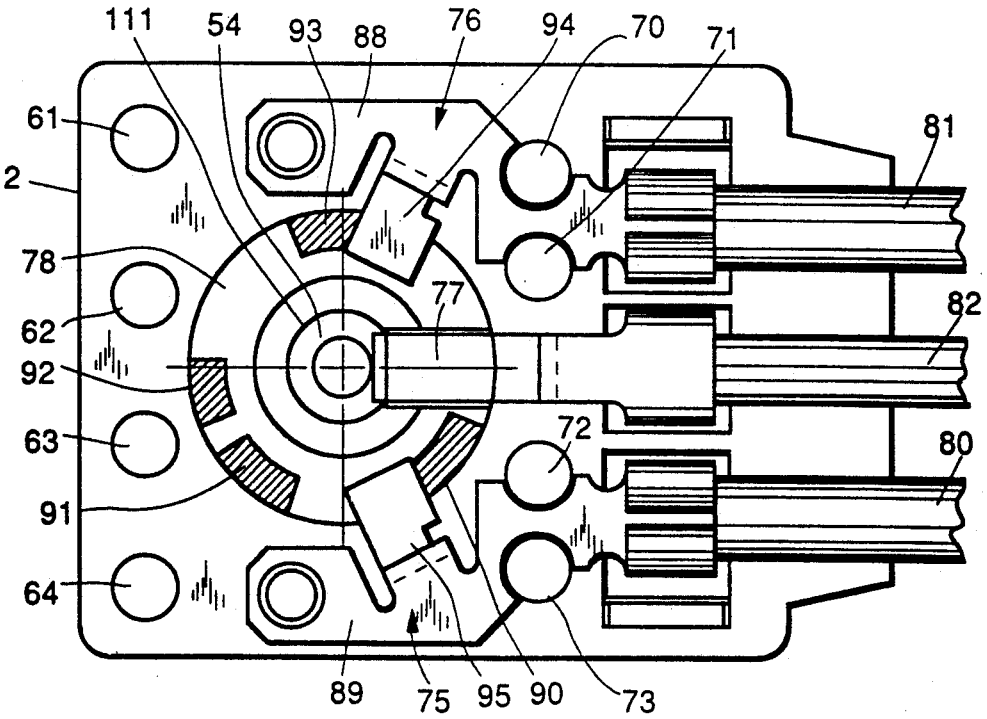
FIG. 13 is a top plan view of the cover portion of the switch shown in FIG. 11.

Switch operation is described below with additional reference to FIG. 13. A tab 53 is initially located on the left planar contact portion 95 completing a circuit through the switch between the common terminal 77 and the left terminal 75. The primary spring 107 is biasing the ratchet 40 into the plunger 30 as far as it will go, engaging the dogs 45 within the ways 28. The ratchet 40 has transferred the primary spring force to the plunger 30 and has moved it into the barrel 5 to its fullest extent, the plunger lugs 34 engaging the ways 28. The plunger camming teeth 35 and the ratchet camming teeth 46 are in partial engagement, being about 11° out of full alignment.

Switch actuation begins with a downstroke of the plunger 30. During the beginning and the middle of the downstroke, the plunger 30 and the ratchet 40 move down the barrel 5 compressing the primary spring 107. Near the end of the downstroke, the ratchet dogs 45 travel beyond the end of the splines 26 permitting partial rotation of the ratchet 40. The force of the primary spring 107 acting against the force of the downstroke causes the plunger camming teeth 35 and the ratchet camming teeth 46 to fully engage, rotating the ratchet 40 about 11° clockwise. The rotation of the ratchet 40 is transferred to the contact cup 50 causing rotation of the tabs 53 about the lower center post 98. The terminal planar contact portions 94, 95 are of a sufficient size to permit this amount of rotation by the tabs 53 without loss of physical contact between the tab 53 and the terminal planar contact portions 94, 95 currently engaged.

The continuation of this physical contact between the tab 53 and the terminal planar contact portions 94, 95 provides the switch with its stable on feature. The state of the switch does not change during a partial or teasing downstroke of the plunger 30. Downstroke pressure insufficient to release the ratchet dogs 45 from the ways 28, will not cause the switch to change state upon removal of such downstroke pressure.

At the end of a full downstroke, release of pressure on the plunger 30 initiates an upstroke, permitting the primary spring 107 to return the ratchet 40 and the plunger 30 to their initial positions. During the upstroke of the plunger 30, the ratchet dogs 45, now rotated about 11° from their initial position, are no longer aligned with the ways 28 from which they emerged. The dogs 45 engage the spline ramps 27 and move along their length clockwise. The clockwise movement of the dogs 45 rotates the ratchet 40 and the contact cup 50 about 34°. Each ratchet dog 45 enters the way 28 clockwise from that from which it emerged, moving up its length as far as it can go. In the final position of the ratchet 40, the ratchet camming teeth 46 are partially engaged with the plunger camming teeth 35, being again about 11° out of full engagement.

The angular motion of the ratchet 40 of about 34° is transferred to the tabs 53. The initial portion of this rotation moves the tab 53 on the left terminal planar contact portion 95, off the contact allowing the primary spring 107 to move the contact cup 50 to the bottom of the circular recess or cavity 78. The continuation of the rotation results in another one of the tabs 53 engaging one of the ramps 90–93. This tab 53 rides up the ramp lifting all the tabs 53 above the plane of the terminal planar contact portions 94, 95 allowing one of the tabs 53 to come to rest on the right terminal planar contact portion 94 completing a circuit through the switch between the common terminal 77 and the right terminal 76.

By lifting the tabs 53 above the plane of the terminal planar contact portions 94, 95 during each switch actuation, the ramps 90–93 prevent the tabs 53 from impacting the terminal contacts' side and top connecting edges. This prevents undesirable tab and contact wear. The height by which the ramps 90–93 lift the tabs above the plane of the planar contact portions 94, 95, however, is not critical. Therefore, a precision molding process with respect to the ramp and terminal platform heights is not required, permitting the switch to be more economically manufactured.

Successive plunger strokes will result in a tab 53 coming to rest alternatively on the left and right terminal planar contact portions 94, 95, completing a circuit through the switch between the common terminal 77 and alternatively the left and right terminals 75, 76.

While the preferred embodiment described above is directed to a two position, single throw switch, the present invention is not limited to use on this type of switch. In another preferred embodiment, one of the left or right terminals 75, 76 may be removed causing the switch to operate as a single pole, on-off switch.

In view of the foregoing, it will be appreciated that a variety of changes, modifications and variations may be made thereto without departing from the spirit and scope of the invention. For example, there may be a differing number of splines 26, lugs 34 and dogs 45. The spline ramps 27 may be offset from the axis 17 by an angle of more or less than 38°. The cover 2 and body 3 may be held together by a bonding or welding process. The number of tabs 53, ramps 90–93 and terminal planar contact portions 94, 95 may differ from that disclosed above. Single pole, double throw, and double pole, double throw switches may be made incorporating the principles of the present invention. Accordingly, the above description should not be used to limit the scope of the invention as defined in the following claims.

What is claimed is:

1. A switch for completing two portions of an electrical circuit, the switch comprising:

a housing;

a first terminal mounted within the housing connectable with a first portion of the electrical circuit;

contacting means mounted within the housing for interruptibly communicating with the first terminal;

a second terminal mounted within the housing connectable to a second portion of the electrical circuit, and that is disposed in communication with the contacting means;

operating means mounted within the housing for rotating the contacting means;

an actuating element mounted within and projecting through the housing for rotatably driving the operating means when said actuating element is moved from a first position to a second position;

wherein the contacting means is adapted to remain in contact with the first and second terminals subsequent to a first movement of the operating means from the first position to the second position, thus completing an electrical circuit through the switch between the first and second terminals, and to disengage contact with the first and second terminals subsequent to a second movement of the operating means from the first position to the second position, thus interrupting the electrical circuit through the switch;

a biasing element interposed between the actuating element and the contacting means for urging the contacting means into electrical communication with the first terminal, and for assisting the actuating element to return to the first position upon release thereof; and ramping means within the housing for guiding the contacting means into position for communication with the first terminal;

and wherein on sequential movement of the operating means, the contacting means is lifted and rotated above the first terminal, and then is lowered onto the first terminal completing an electrical circuit through the switch between the first and second terminals, and wherein a subsequent movement of the operating means lifts and rotates the contacting means off of the first terminal to disconnect the circuit.

2. The switch of claim 1 wherein the housing comprises a body and a cover.

3. The switch of claim 1 wherein the contacting means comprises a metallic contact cup having a plurality of tabs radially extending from one end for making electrical contact with the first terminal.

4. The switch of claim 1 wherein the operating means comprises a ratchet mechanism.

5. The switch of claim 1 wherein an electrical conduction path is created between the first terminal, the contacting means and the second terminal.

6. The switch of claim 1 wherein the biasing means comprises a spring surrounding the contacting means.

7. The switch of claim 1 additionally comprising a second biasing means, interposed between a portion of the contacting means and a portion of the cover.

8. A switch for alternatively connecting a common lead to one of two portions of an electrical circuit, the switch comprising:

a housing;

a first terminal mounted within the housing connectable with a first portion of the electrical circuit;

a second terminal mounted within the housing connectable with a second portion of the electrical circuit;

contacting means mounted within the housing for alternatively communicating with one of the two terminals;

a common terminal mounted within the housing connectable with the common lead, the common terminal in communication with the contacting means;

operating means mounted within the housing for rotating the contacting means when it is moved from a first position to a second position;

an actuating element mounted within and projecting through the housing for rotatably driving the operating means;

wherein the contacting means is adapted to remain in contact with the first and second terminals subsequent to a first movement of the operating means from the first position to the second position, thus completing an electrical circuit through the switch between the first and second terminals, and to disengage contact with the first and second terminals subsequent to a second movement of the operating means from the first position to the second position, thus interrupting the electrical circuit through the switch;

a biasing element interposed between the actuating element and the contacting means for urging the contacting means into electrical communication with the first or second terminal, and for assisting the actuating element to return to the first position upon release thereof; and ramping means within the housing for guiding the contacting means alternatively into position for communication with the first or second terminal;

and wherein on sequential movement of the operating means, the contacting means is lifted and rotated above the first terminal, and then is lowered onto the first terminal completing an electrical circuit through the switch between the first and second terminals, and wherein a subsequent movement of the operating means lifts and rotates the contacting means off of the first terminal to disconnect the circuit.

9. The switch of claim 8 wherein the contacting means comprises a metallic contact cup having a plurality of tabs radially extending from one end for making electrical contact with the first or second terminal.

10. The switch of claim 8 wherein an electrical conduction path is alternatively created between the common terminal, the contacting means and the first or second terminal.

11. The switch of claim 8 wherein the housing comprises a body and a cover.

12. The switch of claim 8 additionally comprising a second biasing means, interposed between a portion of the contacting means and a portion of the cover.

13. The switch of claim 8 wherein the operating means comprises a ratchet mechanism.

14. The switch of claim 8 wherein the biasing means comprises a spring surrounding the contacting means.

15. The switch of claim 8 additionally comprising a second biasing means, interposed between a portion of the contacting means and a portion of the cover.

16. A switch for completing two portions of an electrical circuit, the switch comprising:

a housing having a body and a cover, the body including a barrel portion and the cover including a guide stud extending away from the cover into the housing along the axis of the barrel;

a first terminal mounted on the cover connectable to one portion of the electrical circuit, the terminal having a planar portion.

a contact cup having a partially closed end and an open end, the partially closed end rotatably mounted on the guide stud, the open end having a plurality of tabs extending radially away therefrom, the tabs interruptibly communicating with the first terminal;

a second terminal mounted on the cover in communication with the contact cup and connectable to the other portion of the electrical circuit;

a ratchet mechanism mounted within the housing for rotating the contact cup;

a pushbutton plunger mounted within and projecting through the barrel portion of the housing for rotatably driving the ratchet mechanism and the cup when it is moved from a first position to a second position;

a spring interposed between the tabs and the ratchet mechanism for biasing the tabs into communication with the first terminal, and for biasing the pushbutton plunger to return to the first position upon release thereof; and a plurality of camming ramps in the cover, in communication with one or more of the tabs for lifting the tabs above the planar portion of the first terminal during rotation of the cup;

wherein the contact cup is adapted to remain in contact with the first and second terminals subsequent to a first movement of the plunger from the first position to the second position, thus completing an electrical circuit through the switch between the first and second terminals, and to disengage contact with the first and second terminals subsequent to a second movement of the plunger from the first position to the second position, thus interrupting the electrical circuit through the switch;

and wherein on sequential movement of the plunger, the contact cup is lifted and rotated above the first terminal above the first terminal, and then is lowered onto the first terminal completing an electrical circuit through the switch between the first and second terminals, and wherein a subsequent movement of the plunger lifts and rotates the contact cup off of the first terminal to disconnect the circuit.

17. The switch of claim 16 additionally comprising a second spring mounted between the partially closed end of the cup and the guide stud.

18. A switch for alternatively connecting a common lead to one of two portions of an electrical circuit, the switch comprising:

a housing comprising a body and a cover, the body having a barrel portion and the cover including a guide stud extending away from the cover into the housing along the axis of the barrel;

a first terminal mounted on the cover connectable to a first portion of the electrical circuit, the terminal having a planar portion;

a second terminal mounted on the cover in a spaced apart relationship with the first terminal connectable to a second portion of the electrical circuit, the second terminal having a planar portion coplanar with the planar portion of the first terminal;

a contact cup having a partially closed end and an open end, the partially closed end rotatably mounted on the guide stud, the open end having a plurality of tabs extending radially away therefrom, the tabs alternatively communicating with the first and second terminal;

a common terminal mounted within the cover in communication with the contact cup for connecting the common lead to the contact cup;

a ratchet mechanism mounted within the housing for rotating the contact cup;

a pushbutton plunger mounted within and projecting through the barrel portion for rotatably driving the ratchet mechanism and the cup when it is moved from a first position to a second position;

a spring interposed between the tabs and the ratchet mechanism for biasing the tabs into communication with the first or second terminal, and for biasing the pushbutton plunger to return to the first position upon release thereof; and a plurality of camming ramps in the cover in communication with at least one tab for lifting the tabs above the planar portion of the first and second terminals during rotation of the cup;

wherein selected ones of the tabs of the contact cup are adapted to lift and rotate above the terminals, and then are lowered onto the first and common terminals and remain in contact with them in response to a first movement of the plunger from the first position to the second position, thus completing an electrical circuit through the switch between the first and common terminals, and are adapted to lift and rotate above the terminals, and are then lowered onto the second and common terminals and remain in contact with the second and common terminals in response to a second movement of the plunger from the first position to the second position, thus completing an electrical circuit through the switch between the second and common terminals.

* * * * *